US009228343B2

(12) United States Patent
Hilliaho

(10) Patent No.: US 9,228,343 B2
(45) Date of Patent: Jan. 5, 2016

(54) PANEL SYSTEM

(71) Applicant: LUMON INVEST OY, Kouvola (FI)

(72) Inventor: Esa Hilliaho, Valkeala (FI)

(73) Assignee: LUMON INVEST OY, Kouvola (FI)

( * ) Notice: Subject to any disclaimer, the term of this patent is extended or adjusted under 35 U.S.C. 154(b) by 0 days.

(21) Appl. No.: 14/435,876

(22) PCT Filed: Oct. 28, 2013

(86) PCT No.: PCT/FI2013/051009

§ 371 (c)(1),
(2) Date: Apr. 15, 2015

(87) PCT Pub. No.: WO2014/068178

PCT Pub. Date: May 8, 2014

(65) Prior Publication Data

US 2015/0284949 A1 Oct. 8, 2015

(30) Foreign Application Priority Data

Nov. 1, 2012 (FI) ..... 20126145

(51) Int. Cl.
*E04B 2/82* (2006.01)
*E04B 2/72* (2006.01)
(Continued)

(52) U.S. Cl.
CPC . *E04B 2/827* (2013.01); *E04B 2/72* (2013.01); *E04B 2/828* (2013.01); *E05D 15/0608* (2013.01); *E05D 15/58* (2013.01); *E06B 3/924* (2013.01); *E05Y 2900/142* (2013.01)

(58) Field of Classification Search
CPC ..... E05D 15/0608; E05D 15/58; E05D 2015/586; E05Y 2900/142; E06B 3/924; E04B 2/827; E04B 2/828; E04B 2/72
USPC ..... 49/127–130, 163; 16/97
See application file for complete search history.

(56) References Cited

U.S. PATENT DOCUMENTS 479,532 A * 7/1892 Sallee ..... E05D 15/58 49/258
1,263,572 A * 4/1918 Latham ..... E06B 3/50 49/127

(Continued)

FOREIGN PATENT DOCUMENTS

CH 91792 A 12/1921
DE 19951860 C1 5/2001

(Continued)

OTHER PUBLICATIONS

Feb. 6, 2014 Search Report issued in International Application No. PCT/FI2013/051009.

(Continued)

*Primary Examiner* — Brent W Herring
(74) *Attorney, Agent, or Firm* — Oliff PLC

(57) ABSTRACT

A panel system including a sheet-like movable panel; a lower profile carrying the panel weight and acting as a panel guide track; an upper profile supporting the panel from above and acting as a panel guide track; and an opening guide track placed in parallel with the lower profile, carrying the panel weight and acting as a panel guide track. The panel can move from the lower profile onto the opening guide track and simultaneously pivot to an open position, in which the panel weight is carried by both the lower profile and the opening guide track. In an embodiment, an opening angle of the panel with respect to the lower profile in the open position is smaller than 90° or 85°, or not greater than 45°, or is preferably from 10° to 15°. In an example, the panel system further includes a sheet-like immovable panel with an open position.

15 Claims, 5 Drawing Sheets

(51) Int. Cl.

| | |
|---|---|
| ***E06B 3/92*** | (2006.01) |
| ***E05D 15/58*** | (2006.01) |
| ***E05D 15/06*** | (2006.01) |

(56) References Cited

U.S. PATENT DOCUMENTS

| | | | | |
|---|---|---|---|---|
| 1,462,302 | A * | 7/1923 | Phillips | E05D 15/0608 16/DIG. 31 |
| 2,052,089 | A * | 8/1936 | Fairhurst | E04B 2/827 49/127 |
| 2,987,121 | A * | 6/1961 | Haws | E04B 2/827 160/188 |
| 3,235,915 | A * | 2/1966 | Glaser | E04B 2/827 160/199 |
| 3,295,257 | A * | 1/1967 | Douglass | E06B 3/481 160/199 |
| 3,334,375 | A | 8/1967 | Hubbard | |
| 3,343,205 | A * | 9/1967 | Gogerty | E04B 2/827 16/106 |
| 3,394,496 | A | 7/1968 | Pulaski | |
| 3,491,400 | A * | 1/1970 | Hubbard | E06B 3/924 16/96 R |
| 5,930,953 | A * | 8/1999 | Estfeller | E05D 15/0613 49/127 |
| 6,460,293 | B1 * | 10/2002 | Bischof | E05D 15/0608 160/221 |
| 8,627,621 | B2 * | 1/2014 | Liebscher | E05D 15/0608 16/95 R |
| 8,819,994 | B2 * | 9/2014 | Ingram | E04B 2/827 49/125 |
| 2002/0023392 | A1 | 2/2002 | Bischof | |
| 2003/0226315 | A1 * | 12/2003 | Haab | E06B 3/5436 49/127 |
| 2011/0088326 | A1 * | 4/2011 | Ingram | E04B 2/827 49/177 |
| 2013/0212947 | A1 * | 8/2013 | Goldenberg | E06B 3/5054 49/168 |

FOREIGN PATENT DOCUMENTS

| | | | |
|---|---|---|---|
| EP | 2119864 | A2 | 11/2009 |
| WO | 02/29177 | A1 | 4/2002 |
| WO | 03/042482 | A1 | 5/2003 |
| WO | 2004/011752 | A1 | 2/2004 |

OTHER PUBLICATIONS

Feb. 6, 2014 Written Opinion issued in International Application No. PCT/FI2013/051009.

Jan. 14, 2015 International Preliminary Report on Patentability issued in International Application No. PCT/FI2013/051009.

* cited by examiner

PANEL SYSTEM

FIELD OF THE INVENTION

The invention relates to a panel system.

BACKGROUND OF THE INVENTION

Various panel systems can be placed in connection with a building, for example in connection with a balcony, a terrace or a canopy of a building. It is often a panel made of glass or a similar material, the system comprising several panels. Panel systems can also be placed inside a building, for example as walls.

Panel systems typically comprise an upper profile and a lower profile which are used as guide tracks and inside which are placed the movable hinge devices and guides, on which the panel, in turn, is mounted. The panel moves along the guide tracks by means of said hinge devices and guides.

The upper and lower profiles are normally horizontal and fastened to the structures of e.g. a building. The lower profile can be placed flush with the floor or higher than that, for example on the edge of a balcony. By the hinge devices, the single panels can be opened and closed, whereby they are pivoted around a normally vertical rotation axis. By means of the guides in the panel, the panel remains e.g. closed, and when the guide is allowed to come out of the profile, it is possible to open the panel.

The hinge devices may be provided with locking devices for locking the panels to the profile or to another panel. The panels can be moved and opened to form one bundle when a larger opening is to be provided in the system, for ventilation or passage. Panel systems of prior art are disclosed in documents EP 2119864 A2, WO 04/011752 A1, WO 03/042482 A1, and WO 02/29177 A1.

In many cases, the structures on which the upper profile is mounted, change in their dimensions, straightness or in other respects in the course of time, for example because of various loads effective on the building. This may have negative effects on the installation and the functionality of particularly a panel system, in which the panels are suspended from the upper profile and the whole weight of the panels falls on the upper profile.

BRIEF SUMMARY OF THE INVENTION

The aim of the solution to be presented in this description is to eliminate the above described problems of prior art.

The presented solution can be applied in various panel systems which can be placed in connection with a building, for example a balcony, a terrace, a shelter, or a canopy. The panel system can also be placed in connection with a terrace, a shelter or a canopy separate from a building, for example in the form of wall structures for a roof construction. In an example, the panel is made of glass or a similar material which is particularly transparent, and the system comprises several panels.

The panel system according to the presented solution can also be placed inside a building, for example as walls separating rooms from each other. The panel system can also be provided with a door opening. The height of the panel system according to the solution may vary in such a way that the lower profile is flush with the floor or higher than that, for example at the height of a railing. The panel system may extend from the floor to the ceiling. One or more panels may form an entrance or an open window.

The panel system comprises at least one sheet-like movable panel which is substantially vertical. Furthermore, the system comprises a lower profile which is substantially horizontal, supports the weight of the movable panel, and is used as a guide track for the movable panel; and an upper profile which is substantially parallel with the lower profile, supports the movable panel from above, and acts as a guide track for the movable panel; as well as an opening guide track which is placed in parallel with the lower profile, supports the weight of the movable panel, and acts as a guide track for the movable panel. The movable panel can move from the lower profile onto the opening guide track and simultaneously pivot to the open position, in which the weight of the movable panel is carried by both the lower profile and the opening guide track.

In an example, the opening angle of the movable panel with respect to the lower profile in said open position is smaller than 90° or 85°, or not greater than 45°, or is preferably from 10° to 15°.

In an example, the vertical leading edge of the movable panel is configured to follow the lower profile, and the opposite second, trailing vertical edge of said movable panel is configured to move from the lower profile to the opening guide track and to follow the opening guide track when the movable panel is moving to said open position.

In an example, the system comprises at least two sheet-like movable panels which can be moved to the open position in which both the lower profile and the opening guide track support the weight of each movable panel. At the same time, the movable panels are substantially parallel and placed next to each other.

In an example, the system comprises at least one sheet-like immovable panel which is substantially vertical, whose weight is carried by the lower profile, and which is supported by the upper profile. The immovable panel is configured to pivot to an open position, in which one vertical edge of the immovable panel is pivoted in a lateral direction with respect to the lower profile.

In an alternative, in said open position, at least one movable panel is placed in the space between the lower guide and the immovable panel in the open position.

In an alternative, the immovable panel can also be pivoted to be substantially parallel with a movable panel in the open position, wherein the immovable panel and the movable panel are also in parallel.

In a more detailed example, that vertical edge of the immovable panel which is adjacent to the leading vertical edge of the movable panel, is the opening edge.

In an example, the immovable panel and at least one movable panel can be arranged, in the closed position, one after the other and substantially in parallel with each other and with the lower profile. Together, in the closed position, they constitute a substantially uniform wall.

In an example, the movable panel comprises a hinge device fastened to the bottom edge of said panel, configured to follow the lower profile only, and a guide fastened to the bottom edge of said panel, spaced from the hinge device and configured both to follow the lower profile and to move on to the opening guide track and back.

In an example, the movable panel further comprises a hinge device fastened to the top edge of said panel, configured to follow the upper profile only, and a guide fastened to the top edge of said panel, spaced from the hinge device and configured both to follow the upper profile and to disengage from the upper profile and to return to the upper profile.

In an embodiment, the panel system is configured to form a glazing system particularly for a balcony or a terrace.

By means of the presented solution, e.g. the structures of the building are not loaded unnecessarily via the upper profile, and the weight of the profiles will not cause additional loads on these structures. As the panels are supported by the lower profile and the lower profiles support the weight of the panels, the upper profile can be made simpler and it only needs to provide support to the panel in the lateral direction, to prevent overturning. The upper profile can be constructed more compact than profiles of prior art, for example in terms of size or strength. Changes in the structures of the building do not affect the functionality of the system as much as in the state of the art, so that a panel system applying the presented solution can also be placed in connection with structures in which additional loads are to be avoided and/or in which structural changes are already visible. Consequently, the panel system is safe to use.

Another advantage is the fact that the panel is simple and easy to move along the lower profile or other profiles or guide tracks under the panel, for example along the presented opening guide track. The lower profile is simple, and it can be supported to e.g. the floor by simple means.

Yet another advantage of the presented solution is the fact that the panels can be stored close to each other and they have a small opening angle, so that the stored panels take less space. Opening the panels does not require as much space as by techniques of prior art. Thus, placing the panel system on a balcony is easier than before, and more space is available for furnishing the balcony than in a case where the opening angle of the panel is 90° or larger.

The advantage is a reliable and safe structure, because the opened panel is supported at its bottom edge to two supporting points, namely a supporting point in the lower profile and a supporting point in the opening guide track, or in another corresponding guide track or profile, and at its top edge to one supporting point, namely a supporting point in the upper profile.

When the panel is carried by the lower profile, it is easy and simple to move. By constructing a divider at the junction of the lower profile and the opening guide track, to automatically guide the hinge device on one hand and the guide on the other hand along the desired route, for example, onto the lower profile or onto the opening guide track, the operation is simple and the user does not take care of guiding the panel.

Yet another advantage is the fact that when the opening is limited, the panels remain inclined with respect to the lower and upper profiles, so that overturning of the panels is prevented. This is due to e.g. the fact that said supporting points and the upper profile form a sharp angle, seen from above.

When said angle is smaller than 90°, overturning of the panel is prevented. Furthermore, the smaller said angle, the less movement of the panel in the lateral direction. In an example, the angle is about 10° to 15°. In the prior art, locking mechanisms are often needed for preventing the panel from overturning or assuming an inclined position. Applying the presented solution, the hinge devices of the panels can be made simpler, or the locking of the hinge devices to each other or, for example, to the upper profile will not be necessary.

Yet another advantage is the fact that the panel system does not load the upper profile, or the structure in which the upper profile is placed, to an unnecessary extent. The lower profile supports the movable panel and also supports it when the panel is being opened. This makes it possible that the panel does not need to be mounted on the upper profile in such a way that the panel is supported by the upper profile only. By means of the presented solution, the loading of the upper profile is reduced and the structure of the upper profile can be made simpler. Thus, another advantage is the fact that changes in the structures, on which the upper profile is mounted, do not have a negative effect on the function of the panels. Thus, jamming of the panels and particularly their hinge devices or guides occurs less frequently, or corresponding defects can be totally eliminated.

DESCRIPTION OF THE DRAWINGS

In the following, the presented solution will be described in more detail with reference to the appended drawings.

DETAILED DESCRIPTION OF DIFFERENT EMBODIMENTS OF THE INVENTION

FIGS. 1 to 8 show an example of a panel system applying the presented solution. It is, for example, a balcony glazing. FIGS. 1, 3, 5, and 7 show an example of the parts of the panel system and the way of using the panel system.

The panel system comprises two or more panels. When closed, the panels are preferably aligned and placed one after the other or almost one after the other, whereby they constitute a wall or a window, or an entrance that can be opened.

The system comprises a lower profile 2 and an upper profile 1 which are in parallel and spaced from each other, and placed on top of each other in the vertical direction. The panels 3 are placed between the lower profile 2 and the upper profile 1 in such a way that the panels are vertical. The two vertical edges of the panel opposite each other are vertical, and the upper and bottom edges of the panel are horizontal. The lower profile 2 is fastened onto, for example, a floor or a corresponding structure, or, for example, onto a railing or a corresponding structure higher than that. The upper profile 1 is fastened to a ceiling or a corresponding structure, for example on a lower structure of a balcony. In an example, the lower profile 2 is embedded in a floor or a corresponding structure.

Figure 1:
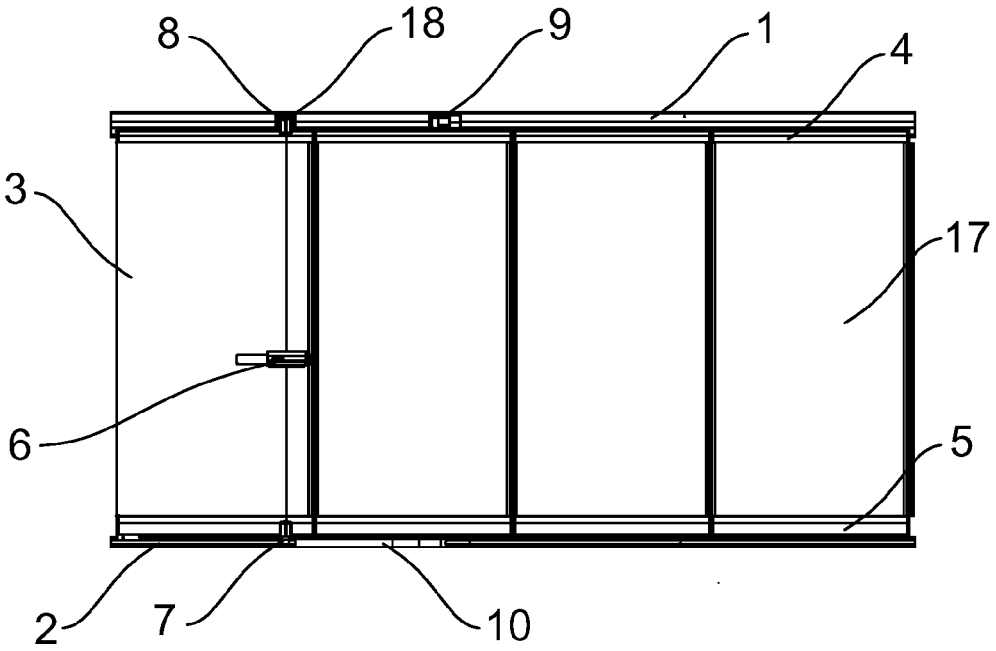
FIG. 1 shows an example of a panel system which applies the panel system according to the solution and in which all the panels are closed, in parallel and placed one after another, seen in a front view.
Figure 2:
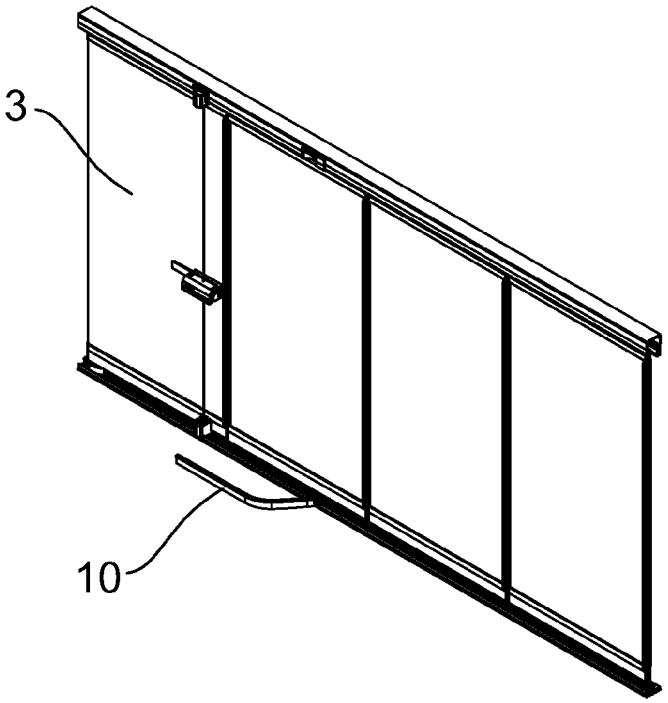
FIG. 2 shows the example of FIG. 1 seen in a slanted view from above.

In an example, such as in FIG. 1, the outermost panel 3 remains stationary, wherein said panel 3 is not movable along the lower and upper profiles. However, the panel 3 can be opened in such a way that it pivots around a vertical rotation axis. Said rotation axis is transverse to the longitudinal directions of the lower and upper profiles. Furthermore, said rotation axis is placed close to one vertical edge of the panel 3.

In an example, the stationary panel 3 is part of said wall when the panel 3 is closed.

Figure 3:
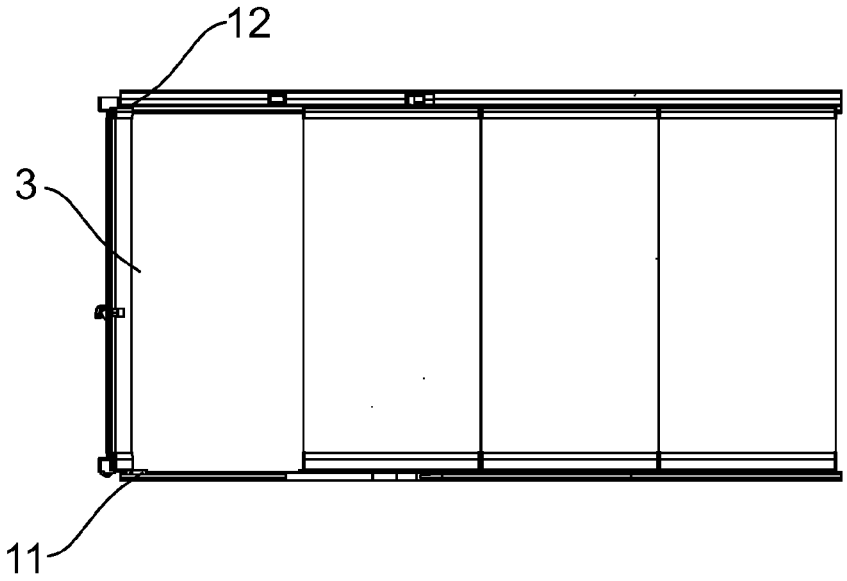
FIG. 3 shows the example of FIG. 1 in a front view, with one of the outermost panels opened.
Figure 4:
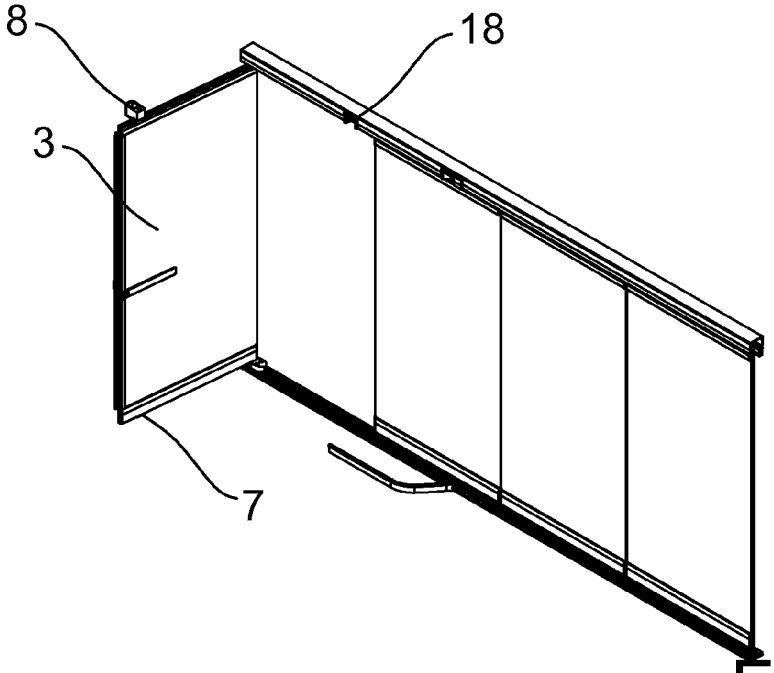
FIG. 4 shows the example of FIG. 3 seen in a slanted view from above.
Figure 5:
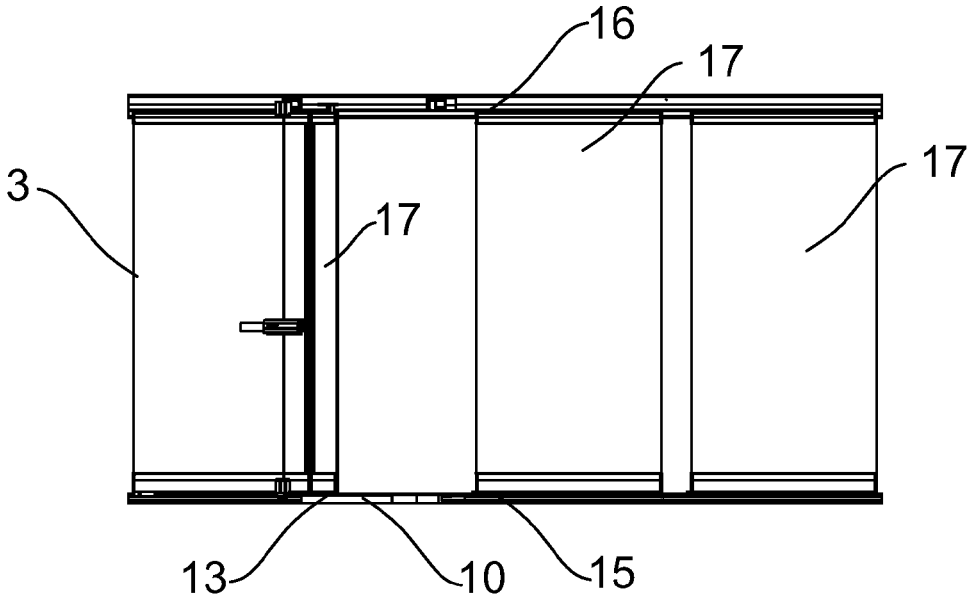
FIG. 5 shows the example of FIG. 1 in a front view, with one of the outermost panels opened, another panel moved to the left and opened by means of an opening guide track, and a third panel moved to the left.

The top edge of the panel 3 is provided with a hinge device 12 placed inside the upper profile 1 and allowing the opening of the panel 3 to the position shown in FIG. 3 and/or FIG. 5. Said rotation axis extends through the hinge device 12. In the example of FIG. 1, the hinge device 12 is stationary in such a way that it cannot move along the upper profile 1. Preferably, the hinge device 12 is locked in the upper profile 1.

The bottom edge of the panel 3 is provided with a hinge device 11 placed inside or on top of the lower profile 2 and allowing the opening of the panel 3 to the position shown in FIG. 3 and/or FIG. 5. Said rotation axis extends through the hinge device 11. In the example of FIG. 1, the hinge device 11 is stationary in such a way that it cannot move along the lower profile 2. Preferably, the hinge device 12 is locked in the lower profile 2.

The hinge device 12 and/or the hinge device 11 of the panel 3 comprises, for example, a shaft journal supporting the panel when it pivots. In an example, the hinge devices comprise parts, in which the shaft journal is engaged and by means of which the panel is connected to the profile.

Furthermore, the top edge of the panel 17 or the panel 3 is preferably provided with a fillet 4 which is fastened to the panel and to which the hinge devices, the guides, and the other parts can be fastened, for example by means of screws or nuts. Furthermore, the bottom edge of the panel 17 or the panel 3 is preferably provided with a fillet 5 which is fastened to the panel and to which the hinge devices, the guides, and the other parts can be fastened, for example by means of screws or nuts.

In an example, such as in FIG. 1, a locking device 8 is fastened to the top edge of the panel 3, engaging the upper profile 1 at a locking point 18 and being spaced from the hinge device 12. The locking device 8 is detachable from the upper profile 1, for opening the panel 3. In the example of FIG. 1, a locking device 7 is also fastened to the bottom edge of the panel 3, engaging the lower profile 2 and being spaced from the hinge device 11. The locking device 7 is detachable from the lower profile 2, for opening the panel 3. The locking devices 7 and 8 are guided by an opening device 6 which moves the locking devices 7 and 8 by means of a force transmitted by e.g. a wire cable, a chain, or a string. The opening device 6 is, for example, a turnable or rotatable handle or knob which is fastened to the panel 3.

In another example, the panel 3 comprises a locking device which is fastened to the top edge of the panel only, engaging the upper profile 1, for example the locking point 18 of the upper profile, and being spaced from the hinge device 12. The locking device is controlled by a cable wire, a chain or a string which can be pulled to open the locking and to open the panel.

Figure 10:
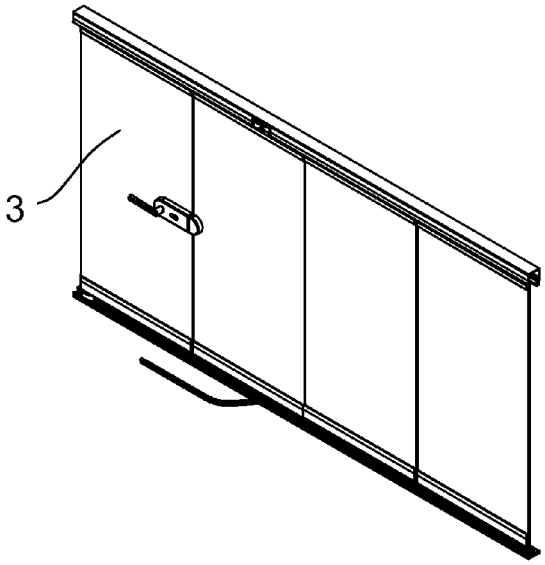
FIG. 10 shows another example which applies the panel system according to the solution and in which all the panels are closed, in parallel and placed one after another, seen in a slanted view from above.

In a third example, the panel 3 comprises a locking device and an opening device which are in the same structure and are fastened to the panel 3. The locking device is locked with the adjacent panel, for example the movable panel 17, as shown in FIG. 10. The adjacent panel is provided with devices having a suitable locking point.

The locking device comprises, for example, at least one tongue which is movable back and forth.

In an example, the opening angle of the panel 3 is about 90° or even more with respect to the closed position in which the panel 3 is parallel with the upper profile 1 and the lower profile 2, and the opening angle is about 0°. In another example, said opening angle is smaller than 90°, for example smaller than 85°. In a third example, said opening angle is not greater than 45°, or is preferably about 10° to 15°. In yet another example, the maximum of the opening angle of the panel 3 corresponds to the maximum of the opening angle of one or more other panels 17.

In the closed position, the movable panel 17 is parallel with the upper profile 1 and the lower profile 2, and the opening angle is about 0°. Preferably, for one or more movable panels 17, disregarding the immovable panel 3, said opening angle is smaller than 90°, for example smaller than 85°, or not greater than 45°, or is preferably about 10° to 15°. When the opening angle is smaller than 90°, overturning of the panel can be prevented, because the hinge device of the opened panel, for example the hinge device 16, cannot move in the direction parallel to the upper profile 1. Instead, said hinge device is supported to the upper profile 1 and the opening guide track 10 or the like.

In an example, as shown in FIG. 1, the panel system comprises one or more panels 17 movable along the lower and upper profiles. In addition, the panel 17 can be opened in such a way that it pivots around a vertical rotation axis. Said rotation axis is transverse to the longitudinal directions of the lower and upper profiles. Furthermore, said rotation axis is placed close to one vertical edge of the panel.

Figure 7:
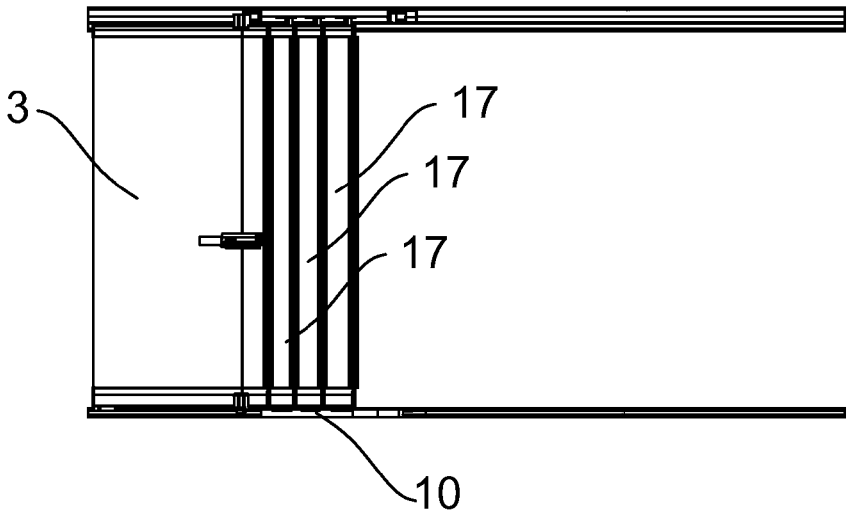
FIG. 7 shows the example of FIG. 1 in a front view, with one of the outermost panels opened and second, third, and fourth panels moved to the left and opened by means of the opening guide track.

The top edge of the panel 17 is provided with a hinge device 16 placed inside the upper profile 1 and allowing the opening of the panel 7 to the position shown in FIG. 5 or FIG. 7. Said rotation axis extends through the hinge device 16. The hinge device 16 is movable along the upper profile 1.

The bottom edge of the panel 17 is provided with a hinge device 15 placed inside or on top of the lower profile 2 and allowing the opening of the panel 7 to the position shown in FIG. 5 or FIG. 7. Said rotation axis extends through the hinge device 15. The hinge device 15 is movable along the lower profile 2.

The hinge device 16 and/or the hinge device 15 of the panel 17 comprises, for example, a shaft journal supporting the panel when pivoting. In an example, the hinge devices comprise parts, in which the shaft journal is engaged and by means of which the panel is movably connected to the profile. The hinge device may comprise horizontal or vertical wheels or rolls, or parts sliding along the profile. In an example, the hinge device, particularly the hinge device 15, is equipped with a vertical roll or wheel which rolls along the lower profile 2. Said vertical roll or wheel is non-pivoting or preferably pivoting.

A guide 14 is fastened to the top edge of the panel 17, placed inside the upper profile 1, movable along the upper profile 1, and spaced from the hinge device 16. Remaining inside the upper profile 1, the guide 14 prevents the opening of the panel 17. An opening 9 is provided in the upper profile to allow the guide 14 to exit the upper profile 1 and to disengage from the upper profile 1, to make the opening of the panel 17 to the position shown in FIG. 5 or FIG. 7 possible.

The guide 14 comprises, for example, parts, via which the panel is movably connected and supported to the profile. The guide may comprise e.g. horizontal wheels or rolls, or parts sliding along the profile. The wheel or roll is non-pivoting or pivoting.

The location of the opening 9 and the spacing of the guide 14 from the hinge device 16 are fitted such that the guide 14 is aligned with the opening 9 at a desired moment. Said moment is when the panel 17 is moved to such a position, in which the panel 17 starts to open by the effect of the opening guide track 10. The panel 17 is moved to a desired location in such a way that the guide 14 is off the upper profile 1.

Preferably, the guide 14 is disengaged and not supported to the upper profile 1 or any other guide track when the guide 13 is moving along the opening guide track 10.

A guide 13 is fastened to the bottom edge of the panel 17, placed inside or on top of the lower profile 2, movable along the lower profile 2, and spaced from the hinge device 15. The guide 13 remaining in the lower profile 2 and following the same, the guide 13 prevents the opening of the panel 17 from the side. In an example, an opening, a port or a divider is provided in the lower profile to allow the guide 13 to exit the lower profile 2 and to disengage from the lower profile 2, so that the opening of the panel 17 to the position shown in FIG. 5 or FIG. 7 is possible. The guide 13 is moved via the opening, port or divider into or onto the opening guide track 10.

According to presented solution, the panel 17 can be moved in such a way that the guide 13 moves along the opening guide track 10 and simultaneously the hinge device 15 moves along the lower profile 2. At the same time, the hinge device 16 moves along the upper profile 1.

The location of the opening, port or divider in the lower profile 2, and the spacing of the guide 13 from the hinge device 15, are fitted so that the guide 13 is aligned with said opening, port or divider at a desired moment. Said moment is when the panel 17 is moved to a position in which the panel 17 starts to open by the effect of the opening guide track 10. The panel 17 is moved to a desired location in such a way that the guide 13 follows the opening guide track 10.

The guide 13 comprises, for example, parts, via which the panel is movably connected and supported to the lower profile 1. In an example, the guide 13 comprises, for example, a shaft journal supporting the panel when pivoted. In another example, the guide 13 comprises a vertical roll or wheel rolling along the lower profile 2 and the opening guide track 10, or a sliding part. Said vertical roll or wheel is non-pivoting or preferably pivoting.

In an example, the lower profile 2 is equipped with a divider blocking the access of the hinge device 15 into the opening guide track 10 and keeping the hinge device 15 inside or on top of the lower profile 2. The hinge device 15 follows the lower profile 2 and passes the opening guide track 10 when the panel 17 moves, for example, to the left or back to the right in FIG. 5. Furthermore, said divider prevents the guide 13 from moving further in the lower profile 2 and forces the guide 13 to move into the opening guide track 10 when the panel 17 moves, for example, to the left in FIG. 5. Said divider allows the guide 13 to move from the opening guide track 10 to the lower profile 2 when the panel 17 moves back to the right.

The hinge device 15 and/or the guide 13 comprises, for example, pins or protruding parts, with which the divider is in contact and by means of which the divider guides the hinge device or the guide in the desired direction, in the direction of either the lower profile or the opening guide track. The hinge devices and/or the guides comprise, for example, rotating parts with guide surfaces supported to the profile.

Preferably, the leading vertical edge of the panel 17 and the hinge device 15 at said vertical edge follow the lower profile 2 continuously. Furthermore, the second, trailing vertical edge of the panel 17 and the guide 13 at said second vertical edge follow the opening guide track 10 after exiting the lower profile 2. Thus, said second vertical edge is at the opening edge of the panel 17, at which an opening is formed in the panel system. The hinge device 16 follows the upper profile 1 continuously, and the guide 14 exits the upper profile 1 when the guide 13 moves onto the opening guide track 10.

Figure 9:
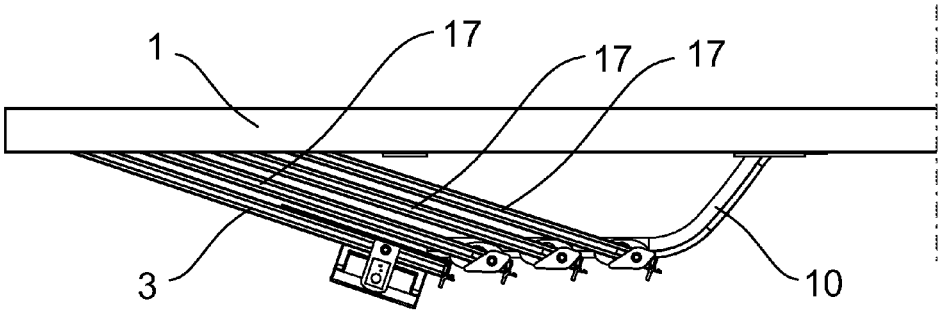
FIG. 9 shows the example of FIG. 7 seen from above.

Preferably, the panel system comprises at least one immovable panel 3 and further one or more movable panels 17. The immovable panel 3 and the movable panel 17 open in the same direction and on the same side of the lower and upper profiles; for example in FIG. 1, they open when pivoted to the left, to the front side of the lower and upper profiles. A panel system corresponding to FIG. 1 can be implemented as a mirror image, wherein the immovable panel is on the right hand side and the panels open when they pivot to the right. The movable panels 17 open in the same direction and are placed next to each other, as shown in FIG. 9. The rear edge of the movable panels 17, that is, the trailing vertical edge, is at the opening edge of the panel.

The opening guide track 10 is placed substantially flush with the lower profile 2. Preferably, the height position of the panel 17 is not substantially changed when it moves onto the opening guide track 10. The total height of the opening guide track 10 can, however, deviate from the lower profile 2. The opening guide track 10 and the lower profile are equipped with e.g. an elevated track which is followed by the guide, for example by means of a grooved roll or wheel. The opening guide track 10 is placed in parallel with the lower profile 2, suitably spaced from the lower profile 2.

Typically, the opening guide track 10 is shorter than the lower profile 2, and the opening guide 10 does not extend farther from the lower profile 2, seen in the longitudinal direction of the lower profile 2. In an example, the starting point of the opening guide track 10, in which e.g. the divider in the lower profile 2 is placed, is placed between the frontmost vertical edge and the rearmost vertical edge of the first movable panel 17. The first movable panel 17 is the panel placed immediately after the immovable panel 3 when the panels are in the closed position.

In an example, the opening guide track 10 comprises a first section which is, for example, at least partly straight and/or at least partly curved and guides the guide 13 in such a way that it moves to a desired distance from the lower profile 2. The opening guide 10 comprises a second section as an extension to the first section, for example at least partly in parallel with the lower profile 2, and guiding the guide 13 in such a way that when moving, the guide 13 remains at a desired, substantially constant distance from the lower profile 2. In another example, the opening guide track 10 and the lower profile 2 are in such an angular position with respect to each other that the resulting opening angle of the panel 17 increases as the panel moves along the opening guide track 10. The distance between the opening guide track 10 and the lower profile 2, particularly the distance between the second section of the opening guide track 10 and the lower profile 2, is configured such that the above presented opening angle and its maximum are formed as desired. By the position of the opening guide track 10, it is possible to affect the maximum opening angle of the panel 17.

In an example, the panel system comprises two or more panels 17 which can be placed in parallel and next to each other in such a way that they are supported to the lower profile 2 on one hand and to the opening guide track 10 on the other hand. The panels 17 are thus stored in the open position. The outermost panel 3 can be pivoted next to the other panels 17 and in parallel with them.

Figure 6:
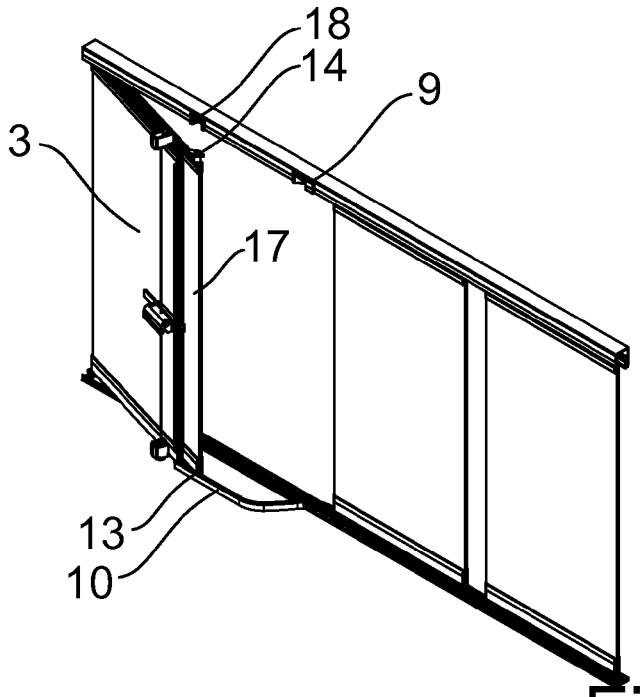
FIG. 6 shows the example of FIG. 5 in a slanted view from above.
Figure 8:
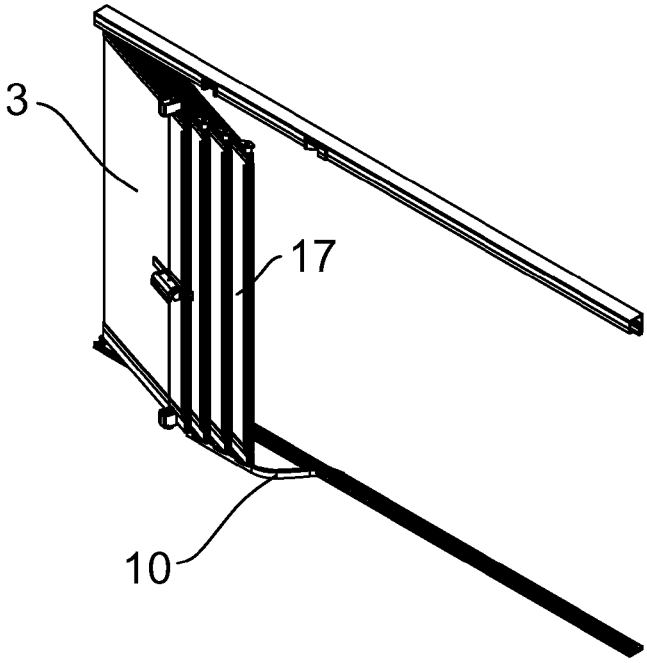
FIG. 8 shows the example of FIG. 7 in a slanted view from above.

In an example, the opening guide track 10 is configured so long that it allows the movement of the panel 17 next to the outermost panel 3, or next to another corresponding panel immovable in position, as shown in e.g. FIG. 6. Thus, the hinge device 16 is placed next to the hinge device 12, and it cannot move further along the upper profile 1. The panel 17 remains in the open position. In another example, the opening guide track 10 is further configured so long that two or more panels 17 are next to each other, for example as shown in FIG. 8 or FIG. 9. Thus, the hinge devices 16 of two different panels 17 are placed next to each other, as are also the guides 13 and the hinge devices 15. The guides 13 are placed in the lower profile 2.

In an example, a third section is provided as an extension to the second section of the opening guide track 10, fastening to the lower profile 2 and supporting the opening guide track 10. In another example, the opening guide track 10 is supported by a supporting structure which is fastened to the lower profile 2 or another structure. In a third alternative, the opening guide track 10 is supported to the floor or a corresponding structure.

In an example, the upper profile and/or the lower profile, or the opening guide track, or also other corresponding guide tracks and profiles, are made of aluminium or an aluminium alloy and have an elongated shape. Other materials and metals are also feasible.

The fillets of the panels are, in an example, made of aluminium or an aluminium alloy, and have an elongated shape. The fillets preferably extend from one vertical edge to the other vertical edge of the panel. Other materials and metals are also feasible.

The hinge devices and the guides are preferably pieces made of plastic material; other materials, such as metal, are also feasible.

In an example, the panel is made of tempered glass. Other glass materials and sheet-like materials are also feasible. The panel is preferably transparent, but non-transparent panels are feasible as well.

The presented panel system and its various embodiments are not limited solely to the examples presented in the appended drawings or particularly discussed in the above specification, or referred to in the specification.

The above presented particular features of the panel system can also be combined and implemented in various combinations which are not presented in the above examples. In particular, in the case of a panel system for a terrace, a roofing, a shelter, or another corresponding construction, the above-presented parts of the system are combined in such a way that the desired construction is formed.

The different embodiments of the invention are disclosed in the appended claims.

The invention claimed is:

1. A panel system comprising:

a movable panel that is sheet-like and substantially vertical, a lower profile that is substantially horizontal, supports the weight of the movable panel, and acts as a first guide track for the movable panel;

an upper profile that is substantially parallel with the lower profile, supports the movable panel from above, and acts as a second guide track for the movable panel;

an immovable panel that is sheet-like, substantially vertical and supported by the upper profile, wherein the weight of the immovable panel is carried by the lower profile, and wherein the immovable panel has a closed position and the immovable panel is configured to pivot to an open position in which one vertical edge of the immovable panel is pivoted in a lateral direction with respect to the lower profile; and an opening guide track that is placed in parallel with the lower profile, supports the weight of the movable panel, and acts as a third guide track for the movable panel, wherein the movable panel can move from the lower profile on top of the opening guide track and simultaneously pivot to an open position, in which both the lower profile and the opening guide track support the weight of the movable panel;

wherein, for moving the movable panel into the open position from a closed position, in which the movable panel is parallel with the lower and upper profiles, a leading vertical edge of the movable panel is configured to follow the lower profile, and further an opposite trailing vertical edge of the movable panel is configured to move from the lower profile to the opening guide track and to follow the opening guide track when the movable panel is moving into the open position;

wherein the movable panel in the open position of the movable panel is placed in a space between the lower guide track and the immovable panel in the open position of the immovable panel;

wherein an opening angle of the movable panel in the open position of the movable panel is not greater than 45° with respect to the lower profile.

2. The panel system according to claim 1, wherein the opening angle of the movable panel in the open position of the movable panel is from 10° to 15° with respect to the lower profile.

3. The panel system according to claim 2, wherein an opening angle of the immovable panel in the open position of the immovable panel is about 90° or more with respect to the lower profile.

4. The panel system according to claim 1, wherein an opening angle of the immovable panel in the open position of the immovable panel is about 90° or more with respect to the lower profile.

5. The panel system according to claim 1, wherein the immovable panel and the movable panel are made of glass or a similar transparent material.

6. The panel system according to claim 1, wherein the immovable panel or the movable panel is configured to form an entrance or an open window.

7. The panel system according to claim 1, wherein the panel system further comprises:

at least one additional movable panel that is sheet-like and can be moved to an open position in which both the lower profile and the opening guide track support the weight of the at least one additional movable panel and the movable panel and the at least one additional movable panel are substantially in parallel and placed next to each other.

8. The panel system according to claim 1, wherein the immovable panel can be pivoted to be substantially parallel with the movable panel in the open position of the movable panel such that the immovable panel and the movable panel are also in parallel.

9. The panel system according to claim 8, wherein the vertical edge of the immovable panel that is adjacent to the leading vertical edge of the movable panel is an opening edge.

10. The panel system according to claim 1, wherein the vertical edge of the immovable panel that is adjacent to the leading vertical edge of the movable panel is an opening edge.

11. The panel system according to claim 1, wherein the immovable panel in the closed position of the immovable panel and the movable panel in the closed position of the movable panel form a substantially uniform wall.

12. The panel system according to claim 1, wherein the movable panel comprises:

a hinge device that is fastened to a bottom edge of the movable panel, wherein the hinge device is configured to follow the lower profile only;

a guide that is fastened to a bottom edge of the movable panel, wherein the guide is spaced from the hinge device and configured to follow the lower profile and to move to the opening guide track and back to the lower profile when the movable panel moves.

13. The panel system according to claim 1, wherein the movable panel comprises:

a hinge device that is fastened to a top edge of the movable panel, wherein the hinge device is configured to follow the upper profile only;

a guide that is fastened to a top edge of the movable panel, wherein the guide is spaced from the hinge device and configured to follow the upper profile when the movable panel moves and to disengage from the upper profile when the movable panel moves into the open position and to return to the upper profile when the movable panel moves into the closed position.

14. A balcony or terrace glazing system, wherein the balcony or terrace glazing system has a panel system configured to constitute a glazing system for a balcony or a terrace, the panel system comprising:

a movable panel that is sheet-like and substantially vertical, a lower profile that is substantially horizontal, supports the weight of the movable panel, and acts as a first guide track for the movable panel;

an upper profile that is substantially parallel with the lower profile, supports the movable panel from above, and acts as a second guide track for the movable panel;

an immovable panel that is sheet-like, substantially vertical and supported by the upper profile, wherein the weight of the immovable panel is carried by the lower profile, and wherein the immovable panel has a closed position and the immovable panel is configured to pivot to an open position in which one vertical edge of the immovable panel is pivoted in a lateral direction with respect to the lower profile; and an opening guide track that is placed in parallel with the lower profile, supports the weight of the movable panel, and acts as a third guide track for the movable panel, wherein the movable panel can move from the lower profile on top of the opening guide track and simultaneously pivot to an open position, in which both the lower profile and the opening guide track support the weight of the movable panel;

wherein, for moving the movable panel into the open position from a closed position, in which the movable panel is parallel with the lower and upper profiles, a leading vertical edge of the movable panel is configured to follow the lower profile, and further an opposite trailing vertical edge of the movable panel is configured to move from the lower profile to the opening guide track and to follow the opening guide track when the movable panel is moving into the open position;

wherein the movable panel in the open position of the movable panel is placed in a space between the lower guide track and the immovable panel in the open position of the immovable panel;

wherein an opening angle of the movable panel in the open position of the movable panel is not greater than 45° with respect to the lower profile.

15. The glazing system according to claim 14, wherein the immovable panel and the movable panel are made of glass or a similar transparent material.

* * * * *